US009611682B2

(12) United States Patent
Forster et al.

(10) Patent No.: US 9,611,682 B2
(45) Date of Patent: Apr. 4, 2017

(54) DEVICE FOR A MOVABLE FURNITURE PART, AND PIECE OF FURNITURE

(71) Applicant: Grass GmbH, Höchst (AT)

(72) Inventors: Kurt Forster, Wangen (DE); Georg Domenig, Kernersville, NC (US); Manfred Peer, Walkertown, NC (US); Cheng Jiang, Kernersville, NC (US)

(73) Assignee: Grass America, Inc., Kernersville, NC (US)

( * ) Notice: Subject to any disclaimer, the term of this patent is extended or adjusted under 35 U.S.C. 154(b) by 0 days.

(21) Appl. No.: 14/504,747

(22) Filed: Oct. 2, 2014

(65) Prior Publication Data

US 2015/0068126 A1 Mar. 12, 2015

Related U.S. Application Data

(63) Continuation of application No. PCT/EP2012/004885, filed on Nov. 24, 2012.

(30) Foreign Application Priority Data

Apr. 5, 2012 (DE) ..... 20 2012 003 508 U

(51) Int. Cl.
*E05F 1/08* (2006.01)
*E05D 11/06* (2006.01)
(Continued)

(52) U.S. Cl.
CPC ..... *E05D 11/06* (2013.01); *E05D 7/00* (2013.01); *E05F 5/006* (2013.01); *E05F 5/06* (2013.01);
(Continued)

(58) Field of Classification Search
CPC .... E05D 11/06; E05D 7/00; E05F 5/06; E05F 5/006
See application file for complete search history.

(56) References Cited

U.S. PATENT DOCUMENTS 3,772,736 A * 11/1973 Hettich ..... E05D 11/1021 16/288
3,975,791 A * 8/1976 Hettich ..... E05F 5/006 16/294
(Continued)

FOREIGN PATENT DOCUMENTS

DE 20 2005 011 752 U1 11/2006
WO 2004/092516 A1 10/2004
(Continued)

OTHER PUBLICATIONS

German Search Report (Application No. 20 2012 003 508.8) dated Jul. 31, 2012.
(Continued)

*Primary Examiner* — Katherine Mitchell
*Assistant Examiner* — Abe Massad
(74) *Attorney, Agent, or Firm* — Burr & Brown, PLLC

(57) ABSTRACT

A device for a movable furniture part having a first stop part which can be attached to a body and is connected via a joint mechanism to a second stop part which can be attached to the movable furniture part for pivoting of the movable furniture part. A damping device is provided, and includes a damper housing and an inner part which is received on the damper housing, which damper housing and inner part can be moved with respect to one another, and the damper housing or the inner part serving as a contact part which, for the damping operation, comes at least temporarily into contact with a section of the device, which section can be moved during the pivoting of the furniture part. A setting mechanism is provided, by way of which setting of the damping action which is provided by way of the damping device can be performed.

18 Claims, 10 Drawing Sheets

(51) Int. Cl.
*E05F 5/00* (2017.01)
*E05D 7/00* (2006.01)
*E05F 5/06* (2006.01)

(52) U.S. Cl.
CPC ..... *E05Y 2900/20* (2013.01); *Y10T 16/551* (2015.01)

(56) References Cited

U.S. PATENT DOCUMENTS

| | | | | |
|---|---|---|---|---|
| 7,065,833 | B2 * | 6/2006 | Kropf | E05D 3/142 16/286 |
| 7,600,295 | B2 * | 10/2009 | Zimmer | F16F 9/0209 16/286 |
| 8,720,010 | B2 * | 5/2014 | Forster | E05F 5/006 16/286 |
| 8,857,014 | B2 * | 10/2014 | Brunnmayr | E05F 5/006 16/319 |
| 9,057,214 | B2 * | 6/2015 | Salice | E05F 5/006 |
| 9,115,525 | B2 * | 8/2015 | Zimmer | E05F 5/006 |
| 2002/0046441 | A1 * | 4/2002 | Brustle | E05F 5/006 16/254 |
| 2006/0026792 | A1 | 2/2006 | Brustle et al. | |
| 2006/0220284 | A1 | 10/2006 | Holzapfel | |
| 2008/0109987 | A1 | 5/2008 | Chen et al. | |
| 2008/0168620 | A1 * | 7/2008 | Hammerle | E05F 5/006 16/85 |
| 2011/0291538 | A1 * | 12/2011 | Brunnmayr | E05F 5/006 312/326 |
| 2013/0000075 | A1 * | 1/2013 | Forster | E05F 5/006 16/84 |

FOREIGN PATENT DOCUMENTS

| | | | |
|---|---|---|---|
| WO | 2009/094272 | A1 | 7/2009 |
| WO | 2010/108201 | A1 | 9/2010 |

OTHER PUBLICATIONS

International Search Report and Written Opinion (Application No. PCT/EP2012/004885) dated Jan. 31, 2013.
International Preliminary Report on Patentability (Application No. PCT/EP2012/004885) dated Oct. 16, 2014.

* cited by examiner

DEVICE FOR A MOVABLE FURNITURE PART, AND PIECE OF FURNITURE

CROSS REFERENCE TO RELATED APPLICATION

This application is a continuation of International Application No. PCT/EP2012/004885 filed Nov. 24, 2012, which designated the United States, and claims the benefit under 35 USC §119(a)-(d) of German Application No. 20 2012 003 508.8 filed Apr. 5, 2012, the entireties of which are incorporated herein by reference.

FIELD OF THE INVENTION

The present invention relates to a device for a movable furniture part and piece of furniture.

BACKGROUND OF THE INVENTION

Pieces of furniture having a furniture part, for example, a door or flap, which is received movably on a furniture body and can be pivoted via a joint mechanism are known. Here, a first stop part is provided on the body and a second stop part of a guide device is provided on the movable furniture part. The guide device can comprise, for example, a hinge or a joint with a pivoting or joint mechanism, respectively.

The guide device can have a damping device for damping the relative movement of device or stop parts, whereby, in the installed state of the guide device, the movement of the movable furniture part can be damped or braked during pivoting of the movable furniture part. The movement damping of the movable furniture part takes place, in particular, on a last part section, for example, before a closed or open position of the movable furniture part relative to the body is reached. In this way, undesired stop noise and/or rebound movements of the furniture part or damage to the device and the furniture can be avoided, which is otherwise the case in a non-damped or non-braked contact of the movable furniture part with corresponding sections, for example, the body.

The damping device which comprises, for example, a fluid damper or a gas or liquid damper has, in particular, components such as a main body with a damper housing which is present thereon including inner part, it being possible for the damper housing and the inner part to be moved in a defined manner relative to one another with the action of a resistance during the pivoting or displacement of the furniture part during operation of the damping device. For example, the inner part can comprise a piston arrangement which can be displaced to and fro in a damper housing which is configured as a cylinder. Here, either the damper housing or the inner part can serve as a contact part which, for the damping action or a damping operation, comes into contact at least temporarily with a section of the device which can be moved during pivoting of the furniture part. When the contact begins, the damping operation of the movement of the relevant parts of the device and therefore of the movable furniture part is initiated.

SUMMARY OF THE INVENTION

It is an object of the present invention to improve pieces of furniture or devices of the type mentioned in the introduction with regard to the damping device.

The invention proceeds from a device for a movable furniture part, in particular, for a door or flap or specifically of a furniture part device, the device having a first stop part which can be attached to a body and is connected via a joint mechanism to a second stop part which can be attached to the movable furniture part for pivoting of the movable furniture part, and there being a damping device, for a damping operation of the relative movement of device parts of the device and therefore during pivoting of the movable furniture part in the mounted state of the device, the damping device comprising a damper housing and an inner part which is received on the damper housing, which damper housing and inner part can be moved with respect to one another, and the damper housing or the inner part serving as a contact part which, for the damping operation, comes at least temporarily into contact with a section of the device, which section can be moved during the pivoting of the furniture part, and setting means being provided, by way of which setting of the damping action which is provided by way of the damping device can be performed.

The device can be, in particular, a hinge or joint.

The core concept of the invention lies in the fact that the setting means comprise a setting arrangement for manual setting without a tool of an extent of the damping action which can be provided by way of the damping device. In the installed state of the device, the setting arrangement is advantageously present in a manner which is accessible for an operation by way of a person, a minimum extent of the damping action which is provided by the damping device during the relative movement of device parts being ensured in every setting.

A damping action can thus be adapted or modified without it being necessary to previously dismantle or disassemble elements on the piece of furniture. However, a damping action which is provided by means of the damping device is advantageously maintained in every setting which is possible by way of the setting arrangement, or at least a residual damping action or the maximum possible damping action is always provided.

The damping action of the device can therefore advantageously be set or defined in a manner which is adapted individually to customer requests or for the respective use. For example, in the case of movable furniture parts which are large and/or are loaded heavily, it is possible to adapt the damping action to the higher moving mass, in order to ensure a sufficient damping action for this case.

Here, the setting arrangement is advantageously configured to define a setting which can be selected from a great spectrum of different settings. In particular, a setting can be modified at any time without aids or without a tool in a manual manner, in particular by hand, which can advantageously take place in one simple step or in an operator-friendly manner.

By way of the setting possibility, the specific damping action can be defined in a variable manner, in particular, in the range between a maximum possible damping action and a minimum possible damping action. A maximum possible damping action can be realized by way of the setting arrangement, for example, via a "zero position" of the damping device.

One advantageous variant of the present invention is distinguished by the fact that the damper housing and the inner part which is received on the damper housing are adapted to one another in such a way that the extent of the damping action which can be provided by way of the damping device can be determined via a basic position of the contact part which is assumed by the contact part at the beginning of the damping operation. For example, the inner part and the damper housing can assume a relative position with respect to one another, the damper housing being situated with respect to the inner part, for example, in the basic position in such a way that the damper housing serves as a contact part and the damping action is provided during the damping operation by way of telescopic displacement with respect to the, in particular, positionally fixed inner part. Depending on the basic position, the displacement path of the damper housing can be greater or smaller, whereby a different damping action can be achieved. The damping characteristic which is realized in principle by way of the damping device is maintained in all possible settings. Merely a possible damping stroke of the damping device or a possible movement path of the contact part is set by way of the setting arrangement. The flow conditions which exist in the damping device within the fluid damper, which conditions bring about the damping action, remain uninfluenced by the setting via the setting arrangement.

After the damping operation with the telescoping of the inner part and the damper housing relative to one another, a return into the basic position is necessary, which is possible, for example, by way of one or more springs, for example by way of two helical springs which are clamped in and act in a tensioned manner between the inner part and the damper housing.

It is also advantageous that the setting arrangement is configured to define one of a plurality of possible different basic positions of the contact part. Thus, as explained above, an associated damping action can in each case be defined via the definition of a specific basic position of the contact part.

It is also advantageous that the setting arrangement is configured to fix a position of a movably mounted stop element, the stop element forming a mechanical stop for the contact part.

Furthermore, it is advantageous that the stop element is adapted so as to form a mechanical stop for the contact part in its basic position. The basic position and therefore the respectively desired damping action can thus be stipulated in a defined manner.

In a further advantageous modification of the subject matter of the present invention, the contact part and the stop element interact in such a way that the contact part can be moved out of the basic position in a direction away from the stop element for a damping operation. The position of the stop element can be modified via the setting arrangement, with the result that, in the basic position, a section of the contact part lies on the stop element and is fixed against a movement in the direction of the stop element, whereas a movement in the opposite direction of the contact part or away from the stop element is possible, whereby the displacement movement of the contact part for the damping action is provided. By way, for example, of the spring means which also bring about the return of the contact part and the inner part relative to one another into the basic position, the contact part can be pressed against the stop means and can thus be positioned in a defined manner in the basic position.

The setting arrangement advantageously comprises a rotational arrangement with an operating part which can be adjusted about a rotational axis. The damping action can thus be manually set in a comfortable manner, compactly and in a robust and simple way.

Furthermore, it is advantageous that the setting arrangement comprises a sliding arrangement with an operating part which can be adjusted along a sliding path.

A sliding movement by way of the operating part also makes it possible that the adjustment can take place reliably and simply and the corresponding damping action can be set as often as desired depending on the defined sliding position of the operating part.

Since the setting arrangement is reversible, that is to say can be actuated in both adjusting directions as often as desired, the damping action can be adapted at any time according to the situation.

In particular, it is advantageously set up that, for example, in the case of a hinge, on which a damping device is integrated, its movement or bearing function for the movable furniture part is maintained in a fully effective manner and without restriction at each possible setting of the damping action.

It is also advantageous that the damping device is positioned in a region of depressed configuration of a stop part, in particular, of a hinge or device cup, preferably in a replaceable manner. A compact and space-saving accommodation of the damping device is thus realized in the case of hinges for pivotably mounting movable furniture parts.

It is also advantageous if the device comprises a joint with precisely one joint axis, about which the pivoting of the movable furniture part takes place by means of the mounted joint. In particular, a single-axis or single-joint hinge can advantageously be used, which is, in particular, of robust and uncomplicated construction.

Finally, the invention relates to a piece of furniture having a body and a movable furniture part, in particular, a door or flap, which is attached to the body, one of the abovementioned devices being provided.

In this way, the abovementioned properties and advantages can be realized on the piece of furniture. The piece of furniture may be, in particular, a box-like furniture body with side walls, a bottom, an upper and a rear side, with at least one furniture part which is attached such that it can be displaced or moved in an articulated manner on the body; for example, a furniture body with a door or flap which is received movably on the body via at least one joint mechanism or, for example, a single-joint or single-axis hinge.

BRIEF DESCRIPTION OF THE DRAWINGS

Further advantages and features of the invention are explained in greater detail using two exemplary embodiments which are shown in the figures.

DETAILED DESCRIPTION OF THE INVENTION

In the two different exemplary embodiments, the same designations are used partially for corresponding elements of the two exemplary embodiments in the figures.

Figure 1:
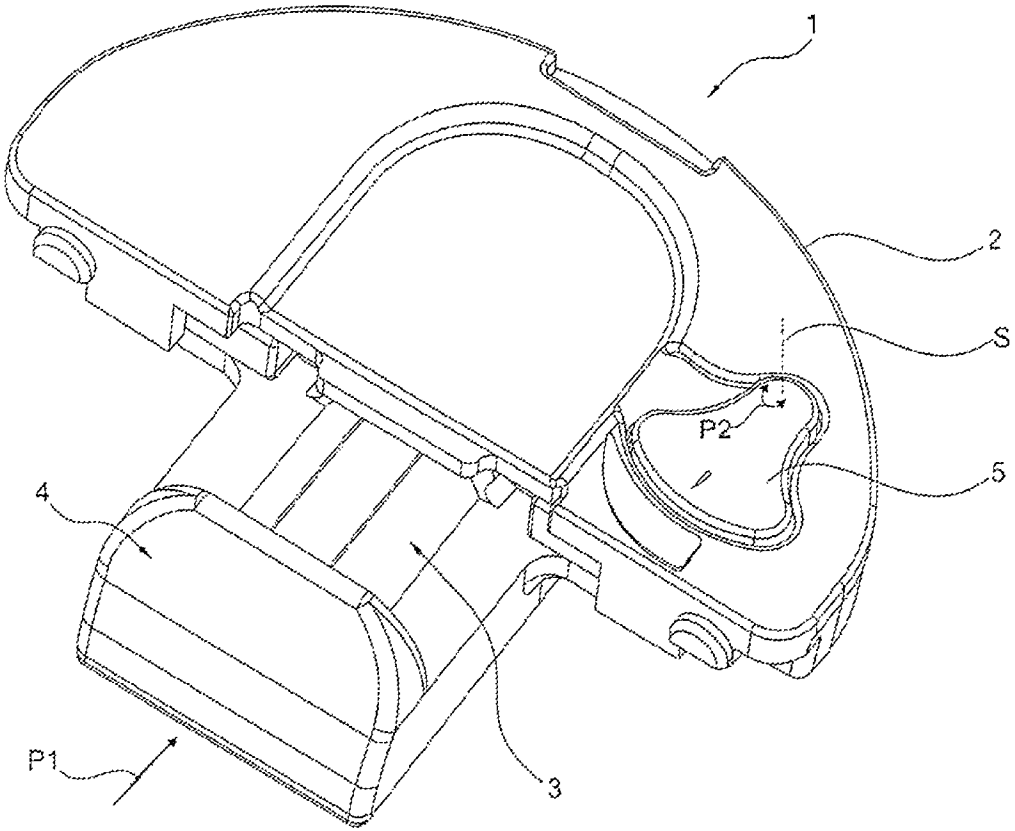
FIGS. 1 to 4 show a first embodiment according to the present invention of a damping device in a view from above and from below, with the omission of spring means of the damping device.

FIG. 1 shows a perspective view obliquely from above of a damping device 1 according to the present invention which is configured to be used on a hinge which serves to pivotably mount a movable furniture part which can be attached pivotably to a furniture body. The damping device 1 is adapted, for example, to be inserted into a suitable depression of a hinge cup (not shown) of the hinge. The hinge cup can be inserted into a depression or receptacle which is prepared in a positionally correct manner on the movable furniture part.

In the installed state of the hinge, the damping device 1 serves to dampen the movement of the furniture part which can be pivoted on the furniture body, a first stop part of the hinge being provided for attachment of the furniture part to the furniture body. In the mounted state of the hinge, a hinge arm of the hinge is connected to the first stop part which is connected to the hinge cup, with the result that the movable furniture part can be moved in a pivoted-back manner by way of the hinge from a closed position which is closed relative to the furniture body into an open position. Here, pivoting of the movable furniture part occurs about a pivot axis which belongs to a pivoting bearing of the hinge. The hinge arm is connected in an articulated manner via a pivoting bearing on the second stop part which can be fixed on the movable furniture part and comprises the hinge cup and a fastening flange.

Figure 2:
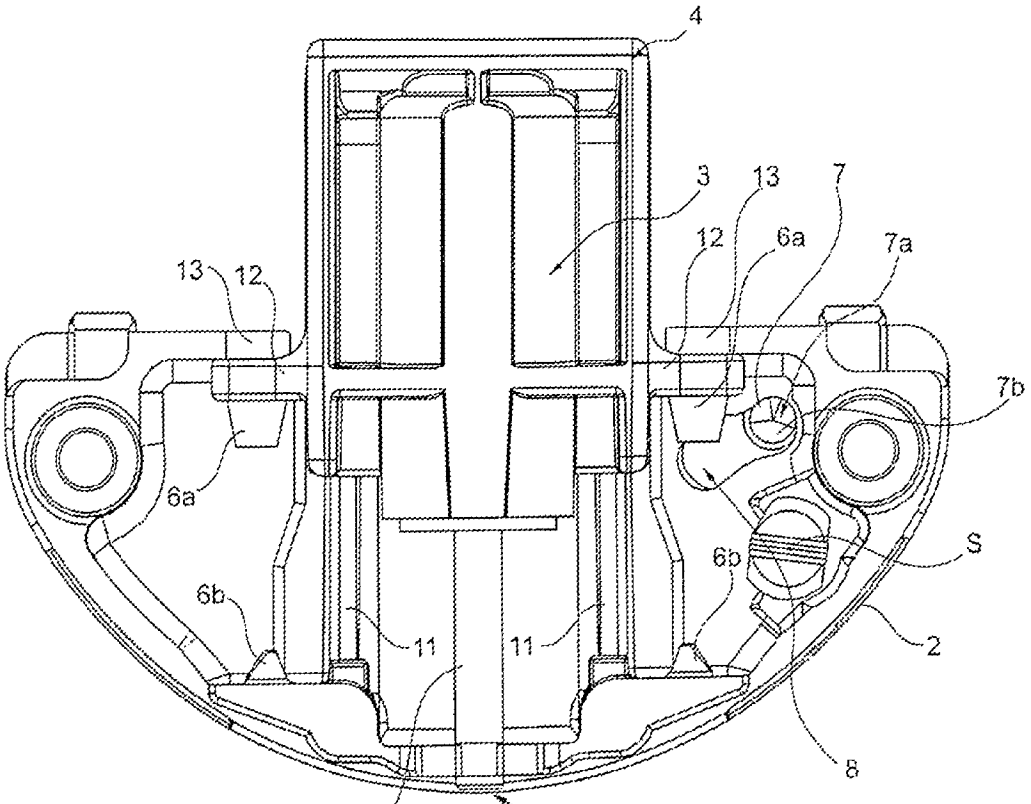

The damping device 1 comprises a base plate 2 which can be supported in the hinge cup and on which a damper cylinder 3 and a damper housing 4 are received in a guided manner such that they can be moved to and fro. As FIG. 2 shows according to a view from below of the damping device 1, the damper housing 4 is guided such that it can be moved inward relative to the base plate 2 according to the arrow P1 in FIG. 1 and such that it can be moved out counter to the direction P1 in a guided manner, and/or can be displaced counter to a damping resistance, the position of the damper housing 4 being shown in FIGS. 1 to 3, in which position the damper housing 4 is moved out to a maximum extent with respect to the base plate 2. The damper housing 4 forms the front section of the damper cylinder 3 which is guided on the base plate 2 via guide webs 11.

Figure 3:
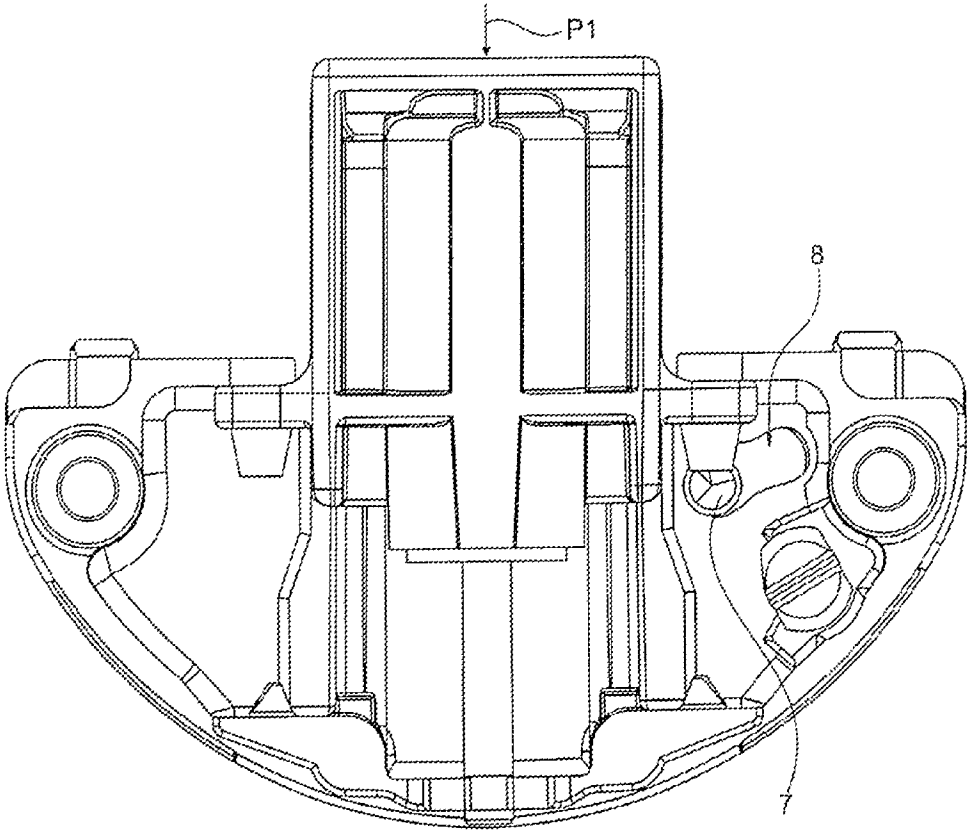

In addition, the damper cylinder 3 is held in the extended stop position according to FIGS. 1 to 3 in a manner which is prestressed with respect to the base plate 2 via springs (not shown), lugs 12 which protrude laterally on the damper cylinder 3 pressing against mechanical stops 13 on the base plate 2. The springs, for example, two helical springs can be inserted in each case in a prestressed manner between two receiving pins 6*a*, 6*b* and can be replaced manually without problems.

During a damping operation, the damper cylinder 3 can be pressed inward out of its protruding position on the base plate 2 (FIG. 1 to 3 or 4) with compression of the springs, which is a precondition for a damping action. In addition, a relative movement occurs here of a piston (not visible) which is received in an inner or hollow volume of the damper cylinder 7, a piston rod 14 being present in a manner which is connected rigidly to the piston, the free end of which piston rod 14 is fixed on a piston rod fixing means 15 on the base plate 2. The piston is also stationary on account of the fixed piston rod 14. The displaceable damper cylinder 3 and the piston including piston rod 14 interact like a piston/cylinder damper or fluid damper which is known per se, and will therefore not be explained functionally in further detail.

The damping device 1 has setting means which are configured as a setting arrangement with a base plate 2 and an adjusting element 5 which is received thereon. For this purpose, the base plate 2 is configured in such a way that, in the case of a hinge cup which is inserted on the furniture part and in which the base plate 2 is inserted, the adjusting element 5 is accessible for manual or tool-less adjustment of the damping device 1. The adjusting element 5 which is held on the base plate 2 is articulated such that it can be rotated about an adjusting element axis S by from approximately 30 to approximately 90°, in particular from approximately 45 to 70°, and can be selectively adjusted in a manner which corresponds to the double arrow P2 in the clockwise direction and counter thereto.

FIGS. 1 and 2 relate to the position of the adjusting element 5 in the position as viewed from above, in which it is turned to a maximum extent counter to the clockwise direction. In this position, the damper cylinder 3 is extended to a maximum extent relative to the base plate 2 and can therefore be pressed in or pushed in by a maximum distance in the direction P1, whereby the damping action is brought about. A damping function of the damping device 1 which is at a maximum or begins as early as possible is realized by way of the position according to FIGS. 1 and 2, in relation to a corresponding movement of the movable furniture part relative to the furniture body. The damper cylinder 3 can move with respect to the base plate 2 as if there were no adjusting element 5.

By way of the rotation of the adjusting element 5 by hand in the clockwise direction (as viewed from above) about the axis S into further positions which differ from that according to FIG. 1, the damping action of the damping device 1 can be adjusted or can be reduced with respect to the state from FIG. 1. To this end, a setting pin 7 is formed on the underside of the adjusting element 5 in a manner which is coupled or connected to the adjusting element 5.

The setting pin 7 reaches into a recess 8 of the base plate 2, the recess 8 being adapted to a possible movement path of the setting pin 7. The recess 8 forms a slotted guide for the setting pin 7. The edge of the recess 8 has rounded edges and, for example, two latching depressions 9 and 10, in which in each case the setting pin 7 can bear in a manner which is secured in the associated rotary position of the adjusting element 5.

Figure 4:
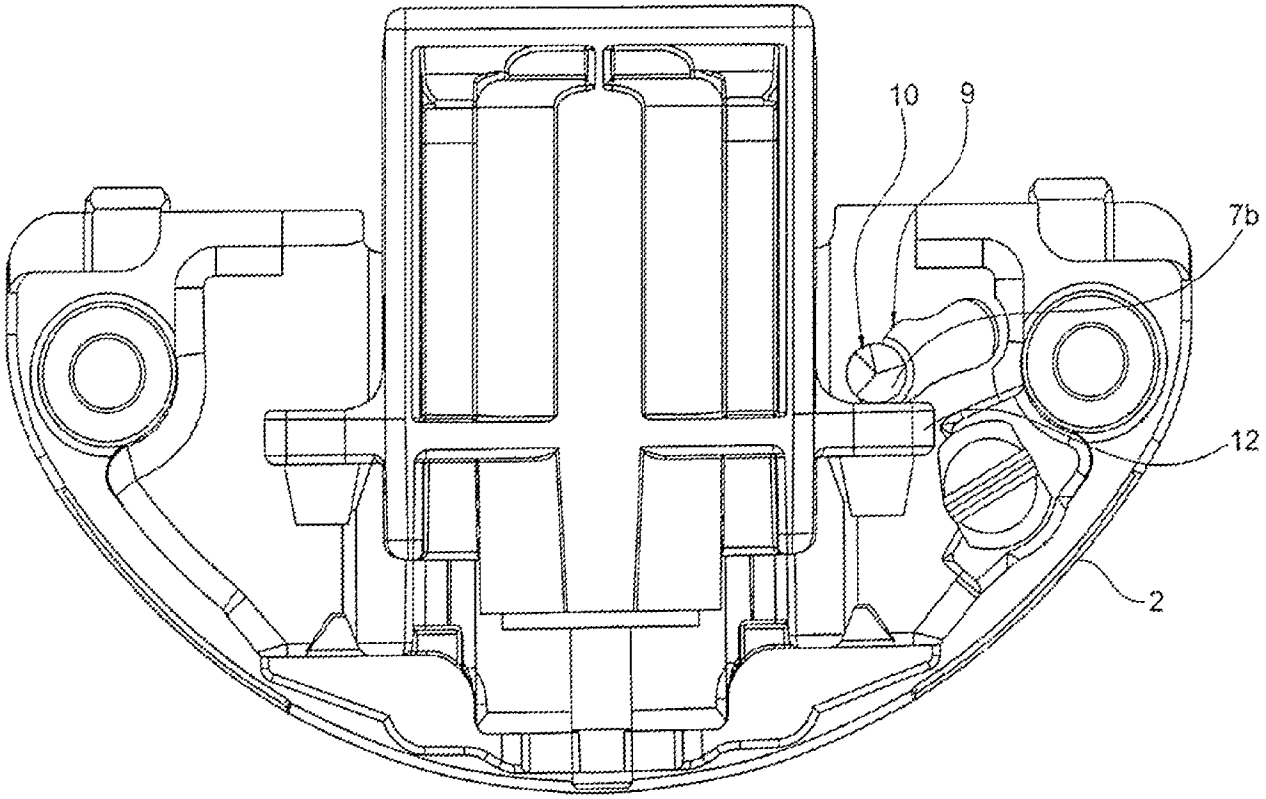
Figure 6:
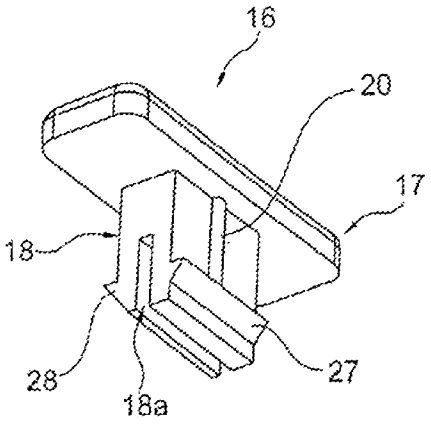
FIGS. 5 to 11 show details of a second embodiment of a damping device according to the present invention, in different views.

The adjusting action of the setting pin 7 becomes clear from FIGS. 2 to 4, according to which various adjusting positions of the setting pin 7 are possible within the recess 8, which adjusting positions can be brought about by way of the turning of the adjusting element 5.

At its axially free end, the setting pin 7 which is cylindrical here by way of example has a downwardly directed end side which is segmented and has spatially inclined end face regions 7*a*, the end face regions 7*a* sloping outward, as viewed radially with respect to the longitudinal axis of the setting pin 7. A further axially frontmost end face region 7*b* is flat or planar, with the result that, when the damper cylinder 3 is pressed back, the lug 12 lies on the outside of the setting pin 7, where the end face region 7*b* is present, and is blocked in terms of its forward movement. This is shown by FIG. 4.

This means that the adjustment of the damping device takes place with an extended damper cylinder 3 according to FIGS. 1 to 3 and the relevant hinge has to be closed firstly after the adjusting operation, with the result that the previously set position of the setting pin 7 is effective only in a next or following damping operation. This is made possible by the wedge-shaped end face region 7*a*. Thus, according to FIG. 3, if the damper cylinder 3 is pressed in, the lug 12 can slide over the oblique faces of the end face regions 7*a* out of the position which is shown in FIG. 3. Therefore, after an adjustment out of that position of the setting pin 7 which is shown in FIG. 2 into the position according to FIG. 3, first of all a closing movement of the movable furniture part is necessary, in order for it to be possible to set up the new position of the damper cylinder 3 according to FIG. 4.

Accordingly, in the case of the setting according to FIG. 3, the damper cylinder 3 including damper housing 4 is moved inward in the direction P1 relative to the base plate 2, the lateral protruding lug 12 coming into contact with the inclined or wedge-like end face 7*a* and sliding over the latter, with the result that the position according to FIG. 4 is reached. Here, the adjusting element 5 can optionally be slightly bent away somewhat from the lug 12. The position of the lug 12 according to FIG. 4, in which it is pressed onto the adjusting pin 7, is realized by way of the helical springs (not shown) which are then prestressed in a compressed manner.

Figure 5:
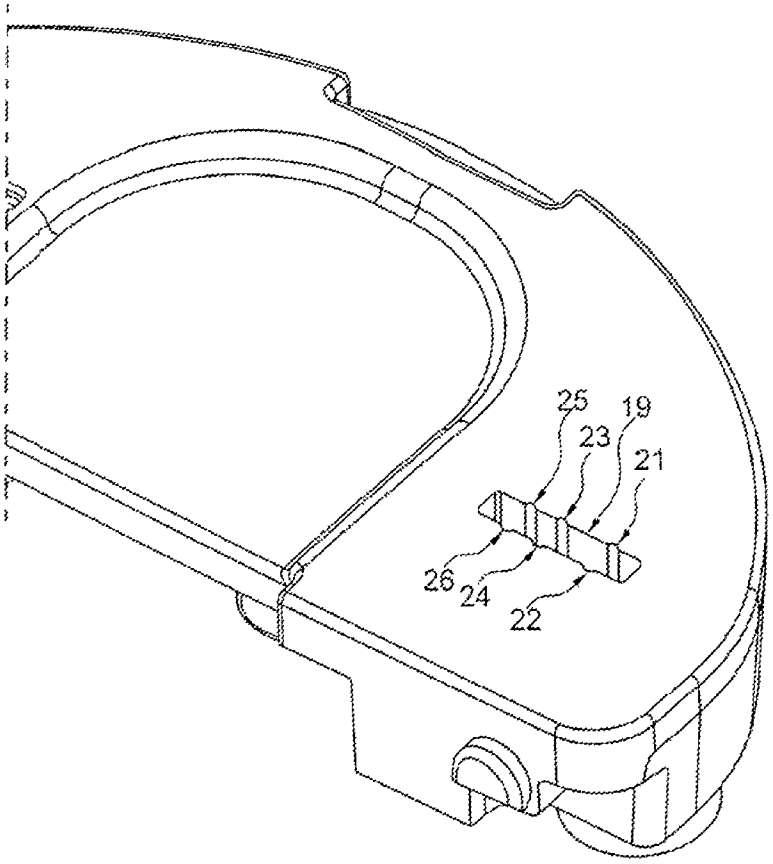
Figure 9:
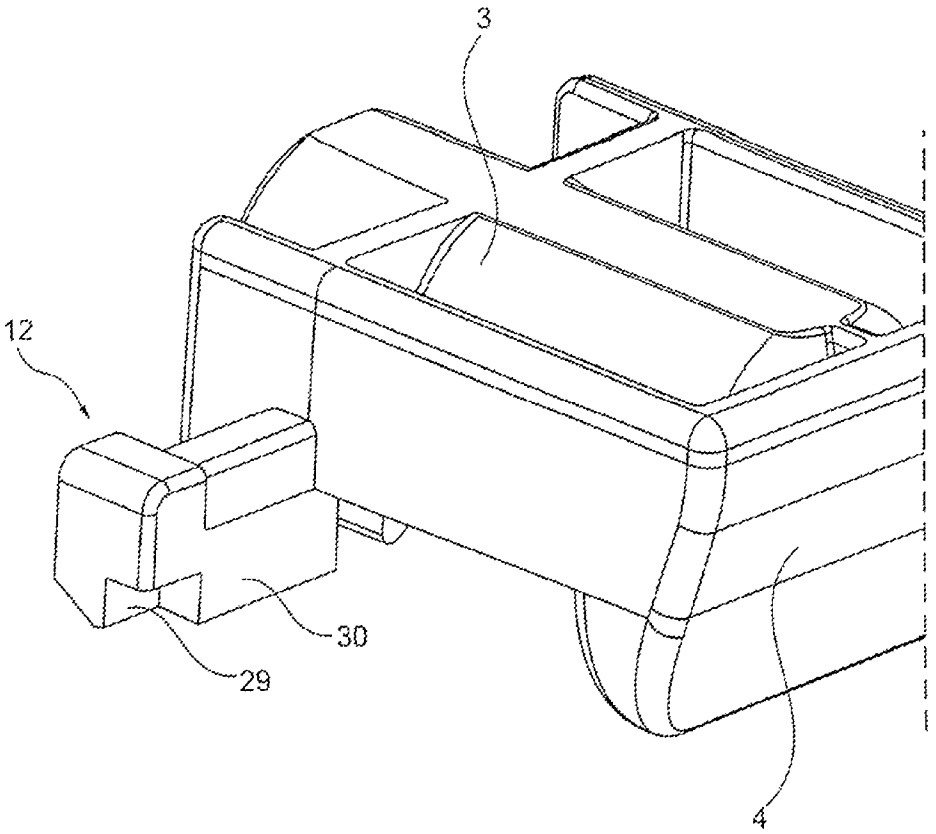

FIGS. 5 to 11 show a comparable arrangement, FIG. 5 showing only the base plate 2 and FIG. 9 showing only the damper cylinder including damper housing. In contrast to the arrangement according to FIGS. 1 to 4, in FIGS. 5 to 11 an arrangement having a sliding element 16 (FIG. 6) instead of the adjusting element for rotation according to FIGS. 1 to 4 is used. The sliding element 16 has a flat head part 17 and a plug-in section 18 which is slotted by means of a notch 18*a*. The notch 18*a* of the plug-in section 18 makes an elastic movement inward possible of arms of the plug-in section 18 which are formed with the notch 18*a*, when the plug-in section 18 is introduced from above into a suitably adapted plug opening 19 in the base plate 2. In addition, the plug opening 19 forms a displaceable guide of the sliding element 16 and, in interaction with the plug-in section 18, defines, for example, three displacement positions of the sliding element 16 relative to the base plate 2.

To this end, web-like elevations 20 which lie opposite one another are provided on the plug-in section 18, which elevations 20 can engage into grooves 21, 22 or 23, 24 or 25, 26 which lie opposite one another in pairs and are adapted correspondingly in a fitting manner to the elevations 20, and the sliding element 16 can therefore assume three sliding positions which are provided in a defined manner and, during the displacement of the sliding element 16, provide feedback by way of a discernible latching action to the person adjusting the sliding element 16, with the result that the person can detect that a latching position has been reached.

The effect of the three possible or predefined adjusting positions of the sliding element 16 corresponds, for example, to that of three possible rotary positions of the adjusting element 5 according to FIGS. 1 to 4.

Moreover, longitudinal ribs 27 and 28 which are triangular in section and protrude laterally for reliable latching in the plug opening 19 and for guiding the movement of the sliding element 16 are formed on the bottom of the plug-in section 18.

Figure 10:
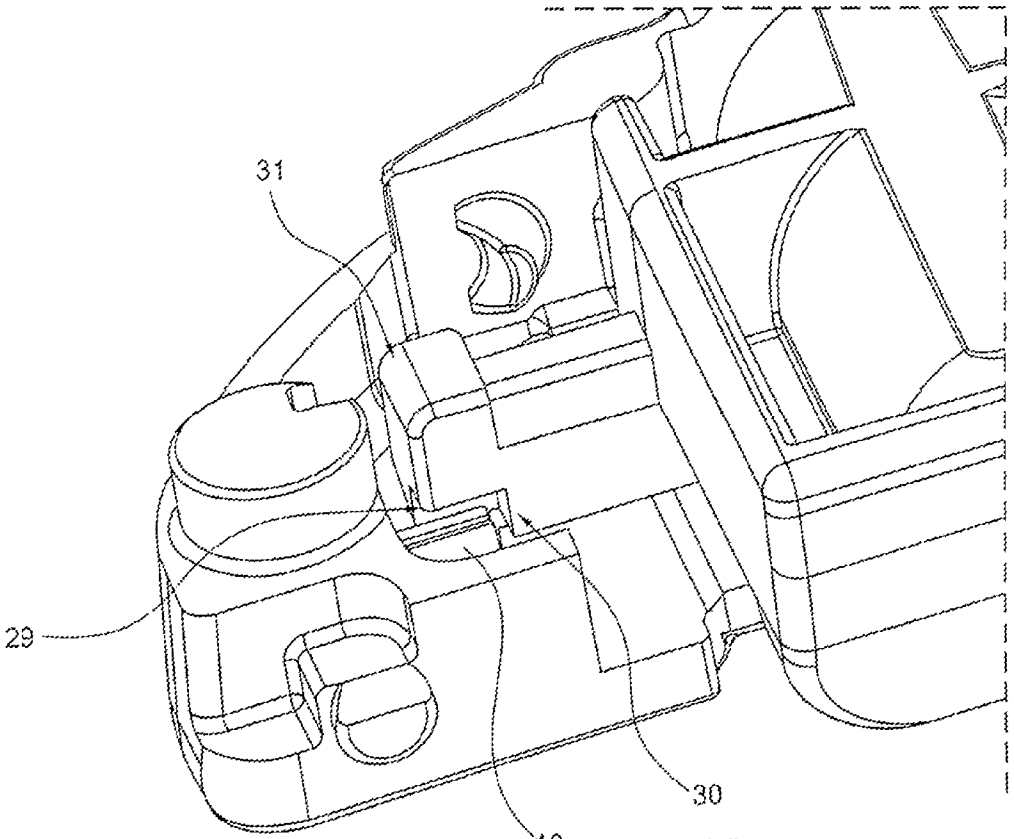
Figure 11:
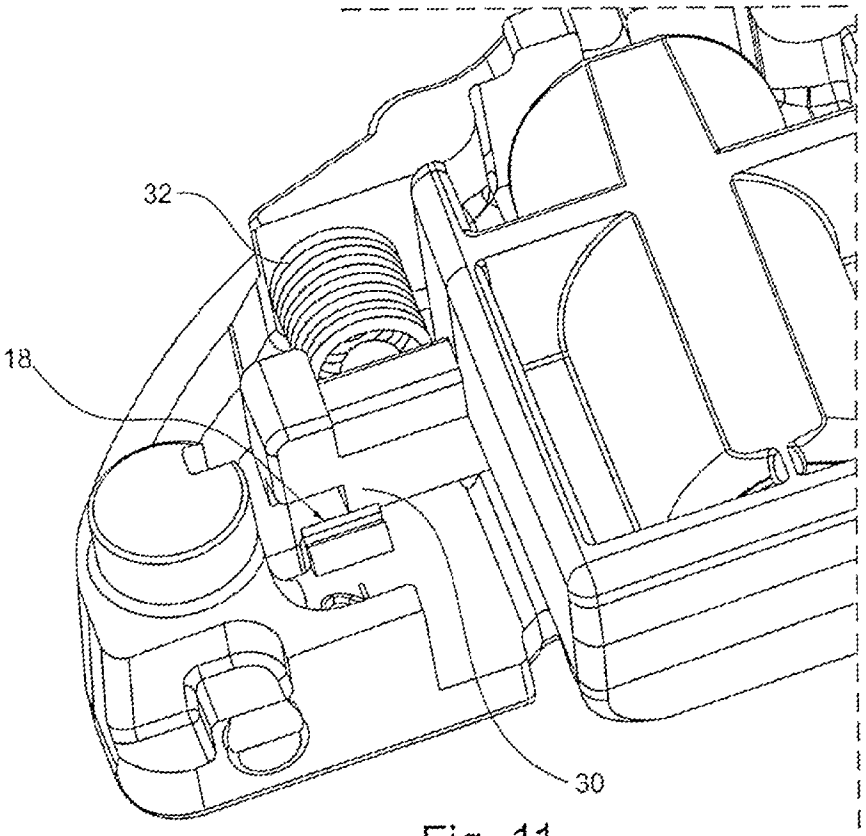

Depending on the displacement position of the sliding element 16, part of the plug-in section 18 on the underside of the base plate 2 does not come into contact with a lug 31 (cf. FIG. 7) or with a rear stop face 29 according to FIG. 10 or a front stop face 30 according to FIG. 11.

Figure 7:
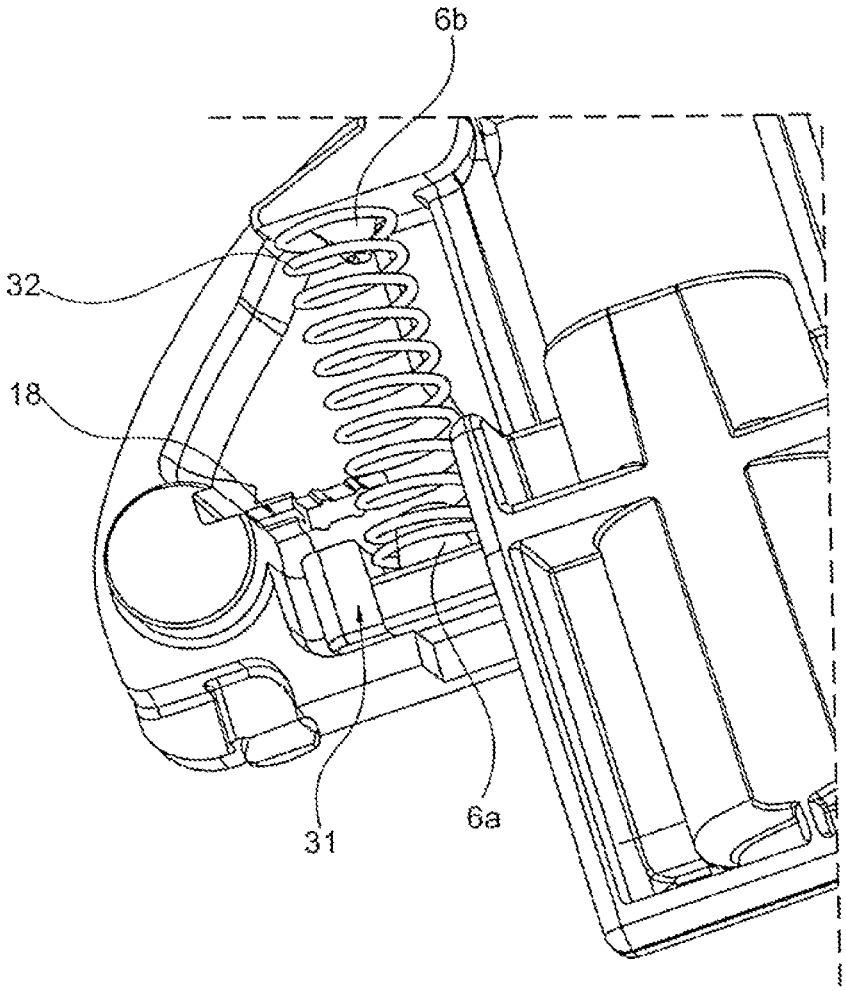
Figure 8:
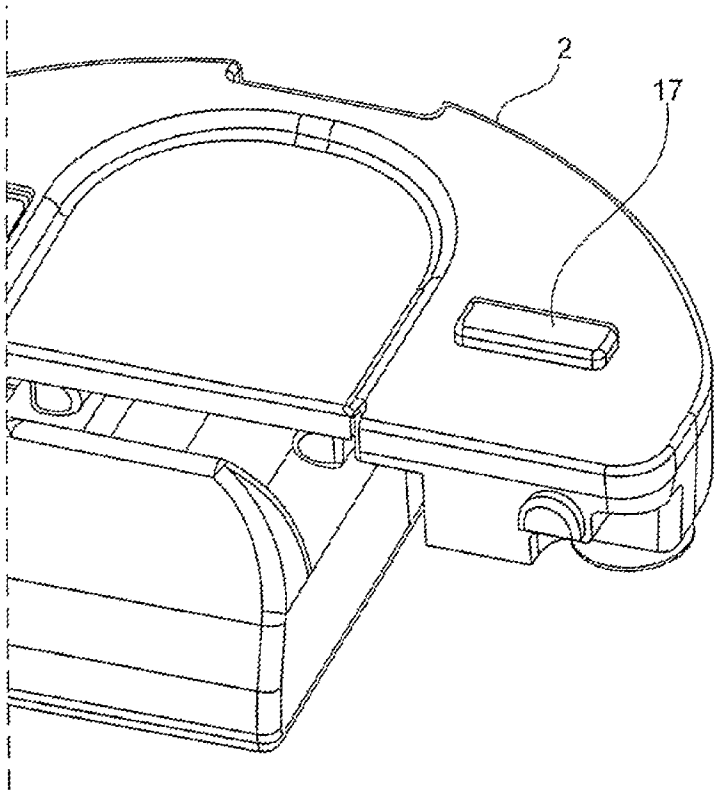

A helical spring 32 which is clamped in between the receiving pins 6*a*, 6*b* is shown in a somewhat expanded form in FIG. 7 or in a completely or virtually completely compressed form in FIG. 11.

In principle, the functional sequence of the adjustment of the damping action in the second exemplary embodiment according to FIGS. 5 to 11 is in accordance with the first exemplary embodiment according to FIGS. 1 to 4; in particular, in terms of the adjustment of the damping device when the damper cylinder 3 is extended, according to which the relevant hinge has to be closed firstly after the adjusting operation, with the result that the previously set position is effected by means of the sliding element 16 only in a next or following pivoting operation of the movable furniture part or a next damping operation. To this end, when the damper housing 4 is pressed in or pushed in, the lug 31 can slide over that part of the plug-in section 18 which protrudes downward on the base plate 2. The stop face 29 or 30 therefore lies on the plug-in section 18 under the action of the spring 32 during the following return stroke of the damper housing 4 and cannot slide over it from this side, whereby the performed setting of the extent of the damping action is then active.

LIST OF DESIGNATIONS

1 Damping device
2 Base plate
3 Damper cylinder
4 Damper housing
5 Adjusting element
6*a*, 6*b* Receiving pin
7 Setting pin
7*a* End face region
7*b* End face region
8 Recess
9, 10 Latching depression
11 Guide web
12 Lug
13 Stop
14 Piston rod
15 Piston rod fixing means
16 Sliding element
17 Head part
18 Plug-in section
18*a* Notch
19 Plug opening
20 Elevation
21-26 Groove
27, 28 Longitudinal web
29 Stop face
30 Stop face
31 Lug
32 Spring

The invention claimed is:

1. A device for a movable furniture part of a furniture body, the device comprising a first stop part which is adapted to be attached to the furniture body and which is connected, via a joint mechanism, to a second stop part which is adapted to be attached to the movable furniture part to pivot the movable furniture part, and a damping device, for performing a damping action during a pivoting movement of the movable furniture part in a mounted state of the device, the damping device comprising a damper housing, an inner part which is received on the damper housing, the inner part defining a longitudinal axis, wherein the damper housing and the inner part are movable with respect to one another, wherein at least one of the damper housing and the inner part comprise a contact part, the contact part, during the damping operation, at least temporarily contacting a movable section of the device that moves during the pivoting movement of the movable furniture part, and setting means for setting a damping action provided by the damping device, wherein the setting means comprise a setting element for manually setting, without a tool, an extent of the damping action provided by the damping device, whereby a minimum extent of the damping action provided by the damping device during the damping action is ensured at every setting, wherein the damping device is positioned in a depressed region of the second stop part, and wherein the damping device includes an adjusting element, the adjusting element being displaceable relative to an adjusting element axis, the adjusting element and the adjusting element axis being spaced away from the longitudinal axis defined by the inner part.

2. The device according to claim 1, wherein the damper housing and the inner part, which is received on the damper housing, are adapted to so that an extent of the damping action provided by the damping device is determined by a basic position of the contact part at a beginning of the damping action.

3. The device according to claim 2, wherein the setting element is configured to define one of a plurality of possible different positions of the contact part.

4. The device according to claim 1, wherein the setting element is configured to fix a position of a movably mounted stop element that forms a mechanical stop for the contact part.

5. The device according to claim 2, wherein a stop element is adapted to form a mechanical stop for the contact part in the basic position of the contact part.

6. The device according to claim 5, wherein the contact part and the stop element interact so that the contact part is moved out of the basic position in a direction away from the stop element for the damping action.

7. The device according to claim 1, wherein the setting element comprises a rotational arrangement with an operating part which is adjusted about a rotational axis.

8. The device according to claim 1, wherein the setting element comprises a sliding arrangement with an operating part which is adjusted along a sliding path.

9. The device according to claim 1, further comprising a joint mounted with a joint axis, about which the pivoting of the movable furniture part takes place via the mounted joint.

10. A piece of furniture having a furniture body and a movable furniture part attached to the furniture body, and a device in accordance with claim 1.

11. The device according to claim 1, wherein the movable furniture part is a door.

12. The device according to claim 1, wherein the movable furniture part is a flap.

13. The device according to claim 1, wherein the depressed region in the second stop part is a cup.

14. The piece of furniture according to claim 10, wherein the movable furniture part is a door.

15. The piece of furniture according to claim 10, wherein the movable furniture part is a flap.

16. The device according to claim 1, wherein the setting element is provided on an upper portion of the damping device with respect to an orientation of the device overall.

17. The device according to claim 1, wherein the adjusting element is rotatable about the adjusting element axis.

18. The device according to claim 1, wherein the adjusting element is rotatable about the adjusting element axis in each of a clockwise direction and a counterclockwise direction.

* * * * *